US009820544B2

(12) United States Patent
Farrelly

(10) Patent No.: US 9,820,544 B2
(45) Date of Patent: Nov. 21, 2017

(54) STACKABLE LUGGAGE ARTICLE

(71) Applicant: Samsonite IP Holdings S.a.r.l., Luxembourg (LU)

(72) Inventor: Sean B. Farrelly, Somerset, MA (US)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 4 days.

(21) Appl. No.: 14/822,814

(22) Filed: Aug. 10, 2015

(65) Prior Publication Data

US 2017/0042302 A1 Feb. 16, 2017

(51) Int. Cl.

| | |
|---|---|
| ***A45C 13/30*** | (2006.01) |
| ***A45C 5/03*** | (2006.01) |
| ***A45C 5/14*** | (2006.01) |
| ***A45C 13/26*** | (2006.01) |
| ***A45C 13/36*** | (2006.01) |

(52) U.S. Cl.

CPC ..... *A45C 13/30* (2013.01); *A45C 5/03* (2013.01); *A45C 5/14* (2013.01); *A45C 13/262* (2013.01); *A45C 13/36* (2013.01); *A45C 2013/306* (2013.01)

(58) Field of Classification Search

CPC ..... A45C 13/262; A45C 5/14; A45C 7/0045; A45C 13/30; A45C 13/38; A45C 13/306; A45C 2013/306

USPC ..... 190/15.1, 18 A, 39, 100, 102, 108, 115

See application file for complete search history.

(56) References Cited

U.S. PATENT DOCUMENTS 5,660,476 A * 8/1997 DeCoster ..... A45C 13/385 190/108
5,685,401 A 11/1997 Macgillivray et al.
5,699,886 A 12/1997 Latshaw
5,799,851 A * 9/1998 Wulf ..... A45C 7/0045 224/580
5,927,450 A * 7/1999 Sadow ..... A45C 5/14 190/102
6,230,771 B1 * 5/2001 Hellenbrand ..... A45C 3/00 150/111
6,536,568 B1 * 3/2003 Tong ..... A45C 13/30 190/101
7,207,426 B2 4/2007 Godshaw et al.
7,232,018 B1 6/2007 Salander
(Continued)

FOREIGN PATENT DOCUMENTS

CN 203505801 U * 4/2014

OTHER PUBLICATIONS

Author Unknown, "Paklite Astro-Lite 55cm Cabin Spinner", obtained at url: http://www.yourhomedepot.com.au/paklite-astro-lite-spinner-55cm-grey.html, known as early as Oct. 10, 2014, 3 pages.

*Primary Examiner* — Sue A Weaver

(74) *Attorney, Agent, or Firm* — Dorsey & Whitney LLP

(57) ABSTRACT

A stackable luggage article (100) is provided. The luggage article may include a luggage case (102) defined by opposing major faces (116), opposing top and bottom end walls (108, 110), and opposing left and right sidewalls (112, 114), the luggage case having a height (H) and a width (W); a plurality of wheel assemblies (160) attached to the bottom end wall; and a first strap (162) defined on a major face. The first strap may extend vertically along at least a portion of the distance between the opposing top and bottom end walls. At least a portion of the first strap may be spaced away from the major face.

20 Claims, 5 Drawing Sheets

(56) References Cited

U.S. PATENT DOCUMENTS

| | | | | |
|---|---|---|---|---|
| 7,314,126 | B2 * | 1/2008 | Godshaw | A01K 1/0254 190/107 |
| 7,467,695 | B2 | 12/2008 | Gormick et al. | |
| 7,775,334 | B2 | 8/2010 | Drew et al. | |
| 8,936,140 | B2 | 1/2015 | Herold | |
| 9,027,722 | B1 * | 5/2015 | Parker | A45C 5/14 190/102 |
| 9,033,125 | B2 | 5/2015 | Herold | |
| 2003/0038008 | A1 * | 2/2003 | Han | A45C 3/00 190/115 |
| 2004/0074725 | A1 * | 4/2004 | Shih | A45C 5/143 190/115 |
| 2004/0238303 | A1 | 12/2004 | Hafif | |
| 2006/0086583 | A1 * | 4/2006 | Hoberman | A45C 7/0045 190/108 |
| 2006/0226619 | A1 | 10/2006 | Sadow | |
| 2007/0089953 | A1 * | 4/2007 | Kohn | A45C 5/14 190/102 |
| 2010/0059322 | A1 * | 3/2010 | Reali | A45C 7/0045 190/108 |
| 2011/0139560 | A1 * | 6/2011 | Via | A45C 1/02 190/102 |
| 2015/0101903 | A1 * | 4/2015 | Schultz | A45C 13/30 190/18 R |
| 2015/0136554 | A1 | 5/2015 | Herold | |
| 2016/0100662 | A1 * | 4/2016 | Drew | A45C 13/30 190/18 A |

* cited by examiner

STACKABLE LUGGAGE ARTICLE

TECHNICAL FIELD

The present disclosure relates generally to wheeled luggage articles, and more specifically to luggage cases with features allowing for engagement with another luggage case for transport.

BACKGROUND

Wheeled luggage articles typically must be transported side by side. Transporting luggage articles side by side creates a large and inconvenient footprint, especially when transporting the luggage articles through busy or tight spaces. Previous attempts to solve the above problems typically include adding a connection strap between the multiple pieces of luggage such that the luggage pieces are in a train configuration. The luggage pieces in such configurations, however, can be difficult to maneuver for at least the same reasons as transporting multiple luggage pieces side by side It is therefore desirable to provide an improved luggage article, and more specifically an improved stackable luggage article that addresses the above described problems and/or which more generally offers improvements or an alternative to existing arrangements.

Documents that may be related to the present disclosure in that they include various luggage articles having a mounting strap include US20040238303A1, US20060086583A1, US20060226619A1, US20150136554A1, U.S. Pat. No. 5,699,886A, U.S. Pat. No. 7,207,426B2, U.S. Pat. No. 7,232,018B1, U.S. Pat. No. 7,467,695B2, U.S. Pat. No. 7,775,334B2, U.S. Pat. No. 8,936,140B2, and U.S. Pat. No. 9,033,125B2.

SUMMARY

According to the present disclosure there is therefore provided a luggage article as described below and defined in the accompanying claims. The present disclosure advantageously provides an easier and more mobile method of transporting multiple luggage pieces through vertical stacking thereof. As explained in detail below, through use of a vertical strap, a first luggage item can be positioned and held horizontally (i.e., on its side) on top of a second luggage item. In this manner, a user can transport multiple luggage pieces together using one hand. Moreover, horizontal mounting of the first luggage item on top of the second luggage item decreases the overall height of the combined luggage assembly for easier and more stable maneuverability than if mounted vertically when stacked. Additionally, the present disclosure allows a larger volume case to be mounted on top than if mounted vertically when stacked.

Embodiments of the present disclosure may include a stackable luggage article. In some embodiments, the luggage article may include a luggage case defined by opposing major faces, opposing top and bottom end walls, and opposing left and right sidewalls, the luggage case having a height and a width; a plurality of wheels attached to the bottom end wall; and a first strap defined on a major face. The first strap may extend vertically along at least a portion of the distance between the opposing top and bottom end walls. At least a portion of the first strap may be spaced away from the major face.

In some embodiments, the first strap may be located centrally on the major face.

In some embodiments, the first strap may include a reinforcing member.

In some embodiments, the height of the first strap may be greater than ½ the length of the first strap.

In some embodiments, the luggage article may include a second strap defined on the major face, the first and second straps being spaced apart. In some embodiments, the first and second straps may be parallel.

In some embodiments, the first strap may extend parallel to one of the opposing sidewalls of the luggage article.

In some embodiments, the first strap may include a first portion having a first connection member, and a second portion having a second connection member. The first strap may be defined by connecting the first and second connection members together.

In some embodiments, a tow handle of a second luggage piece may be receivable through the first strap to mount the luggage article to the second luggage piece. In some embodiments, one of the opposing sidewalls may abut a top wall of the second luggage piece. In some embodiments the length of the first strap may be greater than a maximum width of the tow handle. In some embodiments, the tow handle may be a dual tube tow handle. In some embodiments, a portion of the tow handle may be perpendicular to the length of the first strap when the luggage article is mounted to the second luggage piece. In some embodiments, the first strap may include first and second elongate edges and opposing ends. The opposing ends may be affixed to the major face. The first and second elongate edges may be openable to permit the tow handle to be received through the first strap. In some embodiments, at least one of the first and second elongate edges may be closeable by zipper to form a pocket defined at least partially by the major face and the first strap. In some embodiments, the major face may be defined by a plurality of panels, the intersections between the plurality of panels defining edges. In some embodiments, the opposing ends of the first strap may be attached to two edges.

In some embodiments, the first strap may be attached to the major face at two locations. In some embodiments, the two locations may be spaced apart. In some embodiments, the attachment of the first strap to the major face may create a space between the major face and a portion of the first strap.

In some embodiments, the first strap may be at least partially resilient. In some embodiments, the first strap may be inextendable.

In some embodiments, the luggage article may include four spinning-type wheel assemblies.

In some embodiments, the first strap may extend across at least ¼ of the width of the luggage article. In some embodiments, the first strap may extend across the entire width of the luggage article.

Embodiments of the present disclosure may include a luggage assembly. In some embodiments, the luggage assembly may include a first luggage article and a second luggage article. The first luggage article may include opposing major faces, opposing minor faces extending between the opposing major faces, a plurality of wheels attached to one of the opposing minor faces, and a strap defined on one of the opposing major faces, the strap extending upwardly from adjacent the plurality of wheels to adjacent the other of the opposing minor faces. The second luggage article may include a tow handle. The tow handle of the second luggage article may be received through the strap of the first luggage article such that the first luggage article is mounted substantially orthogonal to the second luggage article.

In some embodiments, the first luggage article may be stacked vertically above the second luggage article.

In some embodiments, the height of the first luggage article may substantially correspond to or may be less than the width of the second luggage article.

In some embodiments, the tow handle may be a single tube tow handle.

In some embodiments, the width of the first luggage article may substantially correspond to an extension height of the tow handle.

In some embodiments, the strap may be slidably coupled with the tow handle.

In some embodiments, the strap may extend at an angle more or less than orthogonal to the width of the first luggage article. In some embodiments, the strap may allow the first luggage article to lay flat on top of the second luggage article.

In some embodiments, the strap may be used as a handle to traverse the luggage article across a support surface.

Embodiments of the present disclosure may include a method of mounting a first luggage article to a second luggage article. In some embodiments, the method may include providing a first strap on a major face of the first luggage article such that the first strap extends substantially orthogonal to the width of the first luggage article, at least a portion of the first strap operable to define an opening between the first strap and the major face, and passing a tow handle of the second luggage article through the opening defined between the first strap and the major face.

In some embodiments, the method may include resting an opposing sidewall of the first luggage article against a top wall of the second luggage article.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure. One of skill in the art will understand that each of the various aspects and features of the disclosure may advantageously be used separately in some instances, or in combination with other aspects and features of the disclosure in other instances.

BRIEF DESCRIPTION OF THE DRAWINGS

The description will be more fully understood with reference to the following figures in which components are not drawn to scale, which are presented as various embodiments of the disclosure and should not be construed as a complete recitation of the scope of the disclosure, characterized in that.

DETAILED DESCRIPTION

Figure 1:
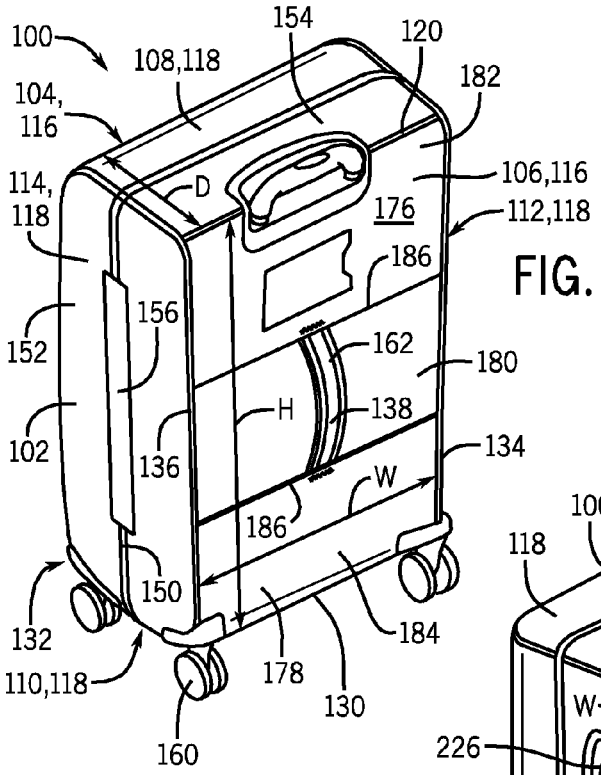
FIG. 1 is a rear isometric view of a luggage article in accordance with some examples of the present disclosure.

Referring to FIG. 1, a luggage article 100 according to an embodiment of the present disclosure includes a luggage case 102 formed from a plurality of walls defining an internal compartment in which to carry a user's belongings. The luggage article 100 includes opposing front and rear walls 104, 106, opposing top and bottom end walls 108, 110, and opposing left and right sidewalls 112, 114 that collectively define the outer structure or case 102 of the luggage article 100 having a height H, a width W, and a depth D. The opposing front and rear walls 104, 106 may define major faces 116 of the luggage article 100, with the opposing left and right sidewalls 112, 114 and the opposing top and bottom end walls 108, 110 forming minor faces 118 of the luggage article 100. The intersections of the major faces 116 and the minor faces 118 define respective edges of the luggage article 100. For example, the intersection between the rear wall 106 and the top end wall 108 defines an upper rear edge 120, the intersection between the rear wall 106 and the bottom end wall 110 defines a lower rear edge 130, and the intersection between the bottom end wall 110 and the front wall 104 defines a lower front edge 132. Similarly, the intersection between the rear wall 106 and the left sidewall 112 defines a rear left edge 134, and the intersection between the rear wall 106 and the right sidewall 114 defines a rear right edge 136. The luggage article 100 may be a bag, a case, a backpack, or any other luggage article, and the luggage article 100 may be soft sided, hard sided, or a hybrid combination of hard and soft sides. As explained below, the luggage article 100 may include a securing structure 138 to permit the luggage article 100 to be secured to a second luggage piece 140 in a stacked configuration (see FIG. 2). As explained below, the luggage article 100 may be formed from a variety of materials and means. Each of the walls 104, 106, 108, 110, 112, 114 may be referred to as a panel, a face, or a side.

Figure 2:
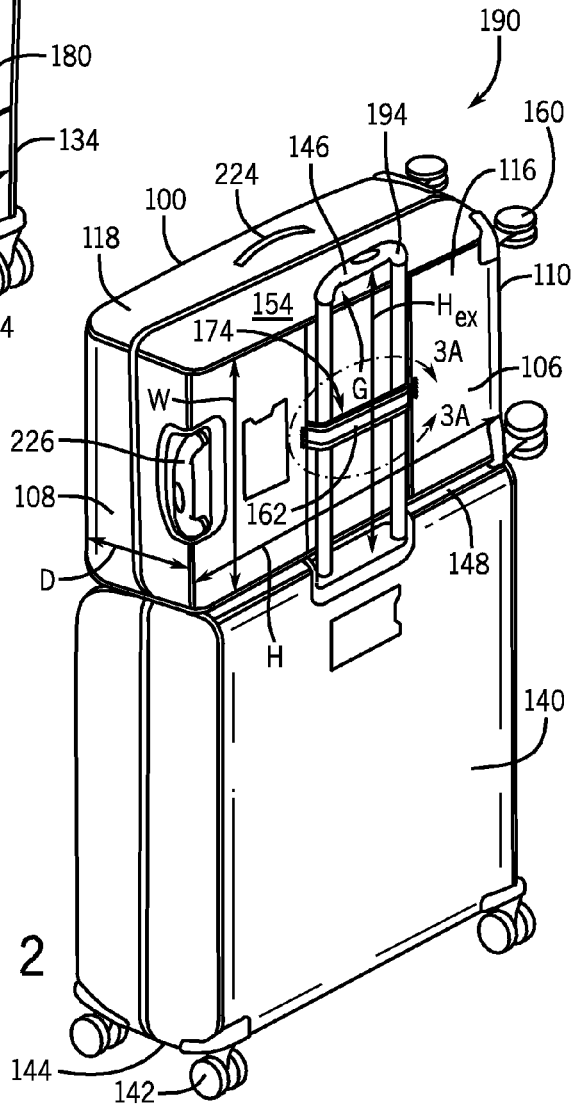
FIG. 2 is a rear isometric view of a luggage article stacked on a second luggage piece to form a luggage assembly in accordance with some examples of the present disclosure.

As shown in FIG. 2, the second luggage piece 140 may be configured substantially identical to the luggage article 100, albeit with different dimensions to accommodate vertical stacking of the luggage article 100 with the second luggage piece 140, as explained below. As illustrated, the second luggage piece 140 may be a spinning-type luggage case having four wheels 142 attached to a bottom wall 144. Additionally, the second luggage piece 140 may include a tow handle 146 extending from a top wall 148 opposite the bottom wall 144. As explained below, the tow handle 146 may be operable to secure the luggage article 100 to the second luggage piece 140 in a vertically-stacked configuration.

With reference to FIG. 1, the luggage article 100 may be split along a split line 150 into a lid section 152, which may include the front wall 104, and a base section 154, which may include the rear wall 106. The lid section 152 may be pivotally connected to the base section 154 along a portion of the split line 150 via a hinge 156, such as a fabric strip, a piano hinge, spaced-apart discrete hinges, a zipper structure, or an articulating joint made of elastomeric material or the like. A closure mechanism 158, such as a zipper or a plurality of latches, may extend along the split line 150 to releasably secure the lid section 152 to the base section 154. In the exemplary embodiment of FIG. 1, the split line 150 extends substantially parallel to the major faces 116 of the luggage article 100, although the split line 150 may jog or extend, at least partially, at an angle relative to at least one major face 116 of the luggage article 100 in some embodiments.

Continuing to refer to FIG. 1, the luggage article 100 may include a plurality of wheel assemblies 160 to rollably traverse the luggage article 100 across a support surface (e.g., the ground). For example, as illustrated in at least FIG. 1, the plurality of wheel assemblies 160 may be attached to the bottom end wall 110, each wheel assembly positioned adjacent an edge or corner of the luggage article 100. As shown, the luggage article 100 may include four caster or spinning-type wheel assemblies 160 to increase the maneuverability of the luggage article 100. Although shown and described as attached to the bottom end wall 110, the plurality of wheel assemblies 160 may be positioned on any wall of the luggage article 100 depending on the particular application and configuration of the luggage article 100.

Figure 3A:
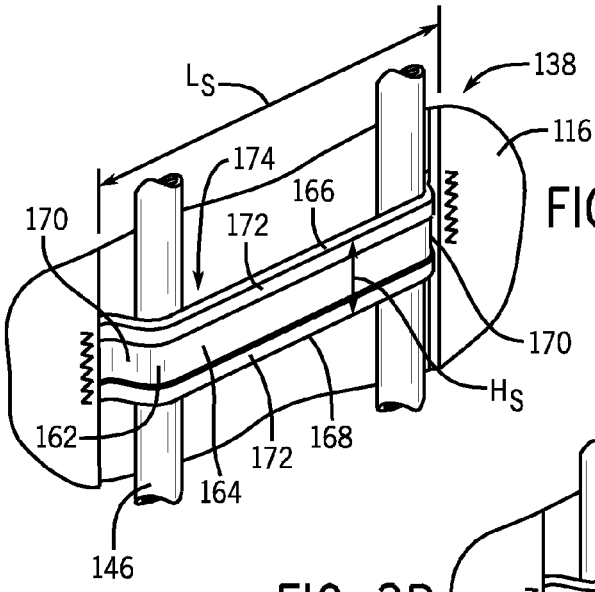
FIG. 3A is an enlarged detail view of a strap connecting a luggage article to a second luggage piece in accordance with some examples of the present disclosure.

With reference to FIGS. 1 and 2, the securing structure 138 of the luggage article 100 includes a first strap 162 defined on a major face 116 (e.g., the rear wall 106 or the front wall 104) of the luggage article 100. As best seen in FIG. 3A, the first strap 162 includes a main body 164 having opposing first and second elongate edges 166, 168 and opposing ends 170. In some embodiments, the main body 164 is at least partially resilient and deformable and may be generally rectangular and have a relatively long length $L_S$ extending along the height H of the luggage article 100, a relatively thin thickness $T_S$ (see FIG. 5), and a height $H_S$ extending along the width W of the luggage article 100. In some embodiments, the height $H_S$ of the first strap 162 may be greater than its thickness $T_S$ and less than its length $L_S$. In some embodiments, the height $H_S$ of the first strap 162 may be greater than ½ the length $L_S$ of the first strap 162. The first and second elongate edges 166, 168 may include a trim piece 172 to protect the edges 166, 168 and provide a desired aesthetic characteristic, as detailed below. Also as explained below, the first strap 162 may include a plurality of layers to provide a desired strength, rigidity, durability, look, and/or feel of the first strap 162.

As shown in FIG. 1, the first strap 162 extends across the major face 116 to secure the luggage article 100 to the tow handle 146 of the second luggage piece 140. In some embodiments, the first strap 162 is provided on the major face 116 in such a way as to allow the luggage article 100 to lay on a sidewall 112, 114 on top of the second luggage piece 140, as detailed below, and secure it in that orientation. In this manner, For example, in the embodiments of FIGS. 1 and 2, the first strap 162 extends along at least a portion of the distance between the opposing top and bottom end walls 108, 110. As shown, the height H of the luggage article 100 extends upwardly from the plurality of wheel assemblies 160 in a vertical direction (see FIG. 1) towards the top end wall 108. In such embodiments, the first strap 162 extends generally vertically along a portion of the major face 116 such that the first strap 162 extends generally orthogonal to the width W of the luggage article 100. Although FIGS. 1 and 2 show the first strap 162 extending orthogonal to the width W of the luggage article 100, in some embodiments, the first strap 162 may extend at an angle more or less than orthogonal to the width W of the luggage article 100. In some embodiments, the first strap may extend at an angle to, or may be parallel with, at least one of the opposing sidewalls 112, 114 of the luggage article 100. As shown, the first strap 162 may be located centrally on the major face 116 of the luggage article 100.

As best seen in FIG. 3A, the first strap 162 may be attached to the major face 116 at two locations, the two locations being spaced apart. For example, the opposing ends 170 of the first strap 162 may be affixed to the interior field of the major face 116 of the luggage article 100 (e.g., such as by stitching) such that the opposing ends 170 are spaced inwardly from the edges defined by the intersection of the major face 116 and the opposing top and bottom end walls 108, 110. In such embodiments, the first and second elongate edges 166, 168 are open or may be openable to permit the tow handle 146 of the second luggage piece 140 to be receivable through the first strap 162. In some embodiments, at least one of the first and second elongate edges 166, 168 may be closeable by a closure mechanism (e.g. a zipper 167) to form a pocket defined at least partially by the major face 116 and the first strap 162 (see FIG. 3F). As shown in FIG. 3F, the zipper 167 may include a pull tab 169 and an elongate zipper tape 171, one half of the zipper tape 171 secured to the major face 116 and the other half of the zipper tape 171 secured to the at least one of the first and second elongate edges 166, 168. As explained below, at least a portion of the first strap 162 may be spaced away from the major face 116 to permit the luggage article 100 to be mounted to the second luggage piece 140 (see FIG. 2). For example, a passage 174 or space may be defined between the major face 116 and a portion of the first strap 162, the passage 174 extending along the width W and orthogonal to the height H of the luggage article 100 (see FIG. 2, for instance). In some embodiments, the attachment of the first strap 162 to the major face 116 may create the passage 174 between the major face 116 and a portion of the first strap 162. In the embodiments described herein, the first strap 162 acts as a securing mechanism to secure the luggage article 100 to the second luggage piece 140, as described more fully below. In embodiments wherein the first and second elongate edges 166, 168 are closeable by a zipper, the zipper may be disengaged between the major face 116 and the first strap 162 to create the passage 174 through which the tow handle 146 may be inserted.

The first strap 162 may be attached to the major face 116 in any suitable manner. For example, the opposing ends 170 may abut, overlap, or be in a tongue and groove configuration with various panels defining the major face 116 of the luggage article 100. As seen in FIG. 1, for example, the major face 116 may be defined by first and second outer panels 176, 178 and an intermediate panel 180 extending between the first and second outer panels 176, 178. As illustrated in FIG. 1, the first outer panel 176 may be positioned within an upper portion 182 of the major face 116 adjacent the upper rear edge 120. Similarly, the second outer panel 178 may be positioned within a lower portion 184 of the major face 116 adjacent the lower rear edge 130. In some embodiments, the first strap 162 is connected to the major face 116 along edges 186 defined by the intersection between the intermediate panel 180 and the first and second outer panels 176, 178. In such embodiments, the intermediate panel 180 may be recessed within the major face 116 such that at least portions of the first strap 162 sits substantially flush with the first and second outer panels 176, 178.

With reference to FIG. 2, the first strap 162 allows the luggage article 100 to be temporarily affixed to the second luggage piece 140 such that the luggage article 100 and the second luggage piece 140 can be transported together as a luggage assembly 190 in a vertically-stacked configuration, the luggage article 100 laying horizontally on top of the second luggage piece 140. In this manner, the overall height of the luggage assembly 190 may be decreased than if the luggage article 100 was mounted vertically when stacked, thus increasing stability and maneuverability to the luggage assembly 190. Additionally, horizontal mounting of the luggage article 100 to the top of the second luggage piece 140 allows a larger volume case to be mounted on top than if mounted vertically when stacked.

Figure 4:
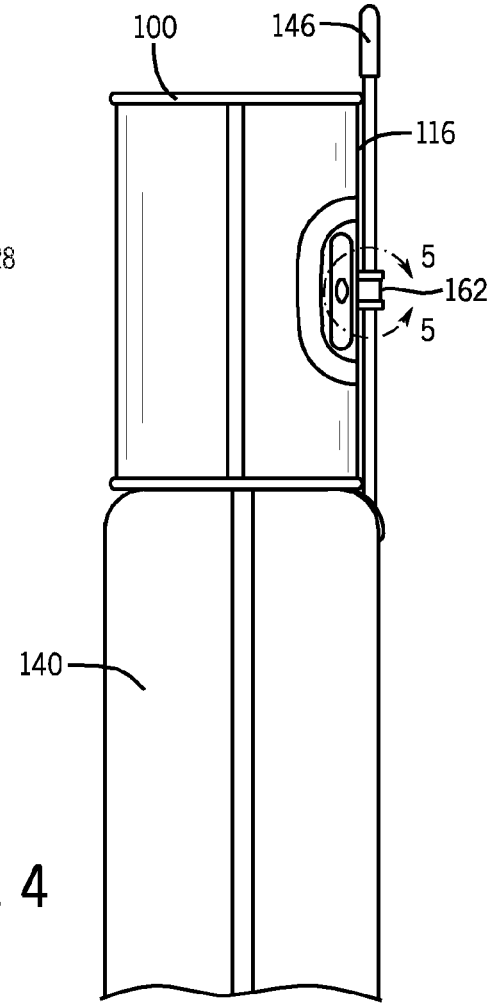
FIG. 4 is a fragmentary side elevation view of the luggage assembly of FIG. 2 in accordance with some examples of the present disclosure.
Figure 5:
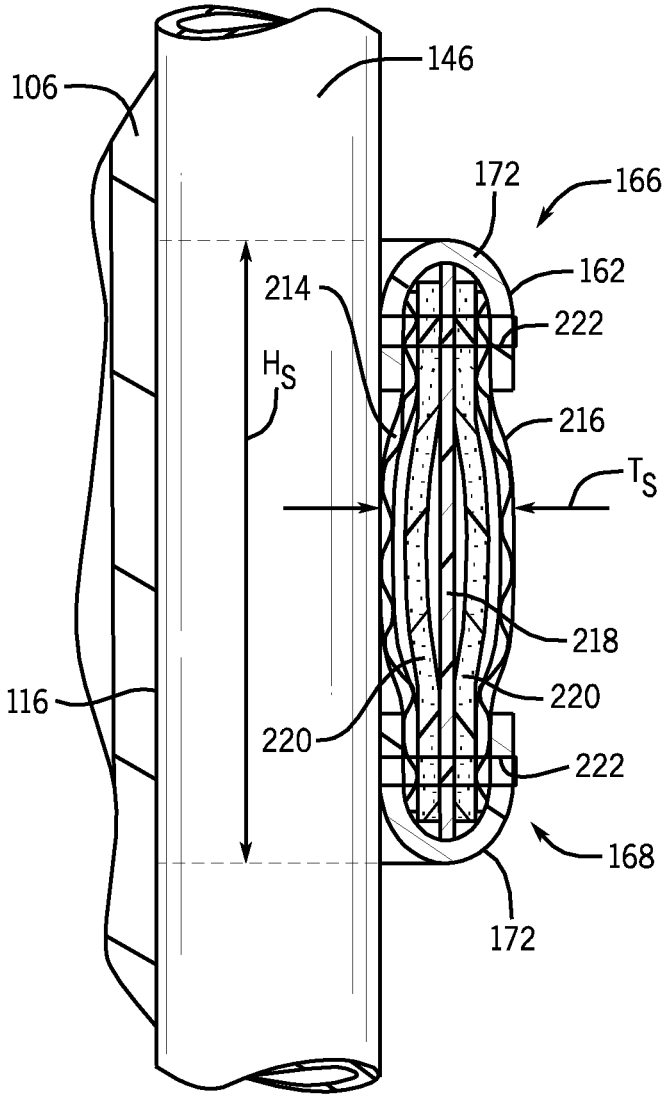
FIG. 5 is a fragmentary cross-sectional view of the luggage article of FIG. 4 taken along detail 5 of FIG. 4 in accordance with some examples of the present disclosure.

To mount the luggage article 100 to the second luggage piece 140, a rigid member (e.g., the tow handle 146) of the second luggage piece 140 is received through the first strap 162 of the luggage article 100 (e.g., through the passage 174) such that the tow handle 146 is at least partially slidably positioned between the first strap 162 and the major face 116 of the luggage article 100 (see also FIGS. 4 and 5). In this manner, the first strap 162 may be slidably coupled with the second luggage piece 140 (e.g., with the tow handle 146) such that the luggage article 100 is positioned and held horizontally (i.e., on one of its opposing sidewalls 112, 114) on top of the second luggage piece 140. When received through the first strap 162 of the luggage article 100, the tow handle 146 extends perpendicular to the length $L_S$ of the first strap 162 and parallel to the width W of the luggage article 100 (see FIG. 3A). As shown, the tow handle 146 of the second luggage piece 140 extends adjacent the rear wall 106 of the luggage article 100 such that the luggage article 100 is stacked vertically above the second luggage piece 140. Once stacked, one of the opposing sidewalls 112, 114 of the luggage article 100 extends parallel to, and may abut or rest on, the top wall 148 of the second luggage piece 140. It is contemplated, however, that once stacked, one of the opposing sidewalls 112, 114 of the luggage article 100 may extend at an angle relative to the top wall 148 of the second luggage piece 140. Once the luggage article 100 and the second luggage piece 140 are connected together via the first strap 162, the user may transport the luggage assembly 190 by grasping the tow handle 146 of the second luggage piece 140. Additionally or alternatively, the first strap 162 may be used as a handle to traverse the luggage assembly 190 across a support surface. In the embodiment of FIG. 2 wherein the second luggage piece 140 is a spinning-type luggage case having four wheels 142, the weight of the luggage article 100 and the second luggage piece 140 is centered over the wheels 142 of the second luggage piece 140 for easier and safe operation of the luggage assembly 190.

With continued reference to FIG. 2, the luggage article 100, including the first strap 162, may be sized to correspond with the dimensions of the second luggage piece 140, or vice-versa. For example, the height H of the luggage article 100 may substantially correspond to, or be less than, the width of the second luggage piece 140. Additionally or alternatively, the depth D of the luggage article 100 may substantially correspond with, or be less than, the depth of the second luggage piece 140. The tow handle 146, which may be a single or dual tube tow handle, includes an extension height $H_{EX}$ that, in some embodiments, substantially corresponds to the width W of the luggage article 100. In some embodiments, however, the width W of the luggage article 100 may be less than the extension height $H_{EX}$ such that a gap G is created between the luggage article 100 and a handle portion 194 of the tow handle 146 to permit a user to grasp the handle portion 194 to traverse the luggage assembly 190 across a support surface. In some embodiments, the length $L_S$ of the first strap 162 may be greater than a maximum width of the tow handle 146 to permit the tow handle 146 to be received through the first strap 162. To prevent undesired shifting of the luggage article 100 relative to the second luggage piece 140, the length $L_S$ of the first strap 162 may closely correspond to the maximum width of the tow handle 146 of the second luggage piece 140.

Figure 3B:
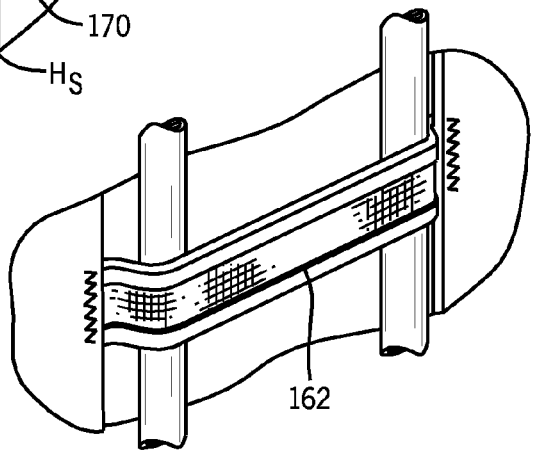
FIG. 3B is an enlarged detail view of an additional strap connecting a luggage article to a second luggage piece in accordance with some examples of the present disclosure.
Figure 3C:
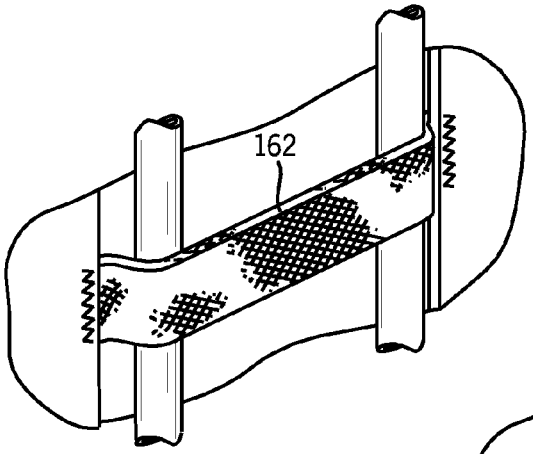
FIG. 3C is an enlarged detail view of an additional strap connecting a luggage article to a second luggage piece in accordance with some examples of the present disclosure.
Figure 3D:
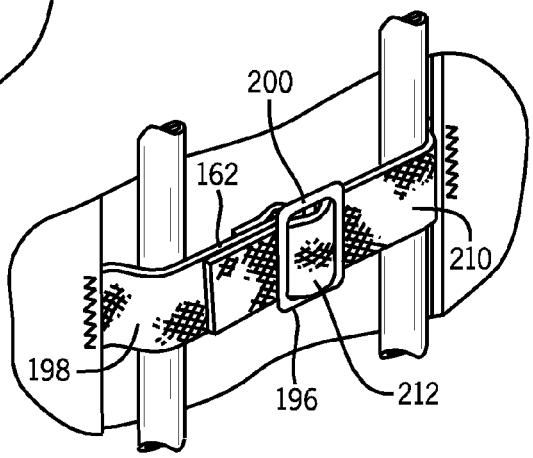
FIG. 3D is an enlarged detail view of an additional strap connecting a luggage article to a second luggage piece in accordance with some examples of the present disclosure.
Figure 3E:
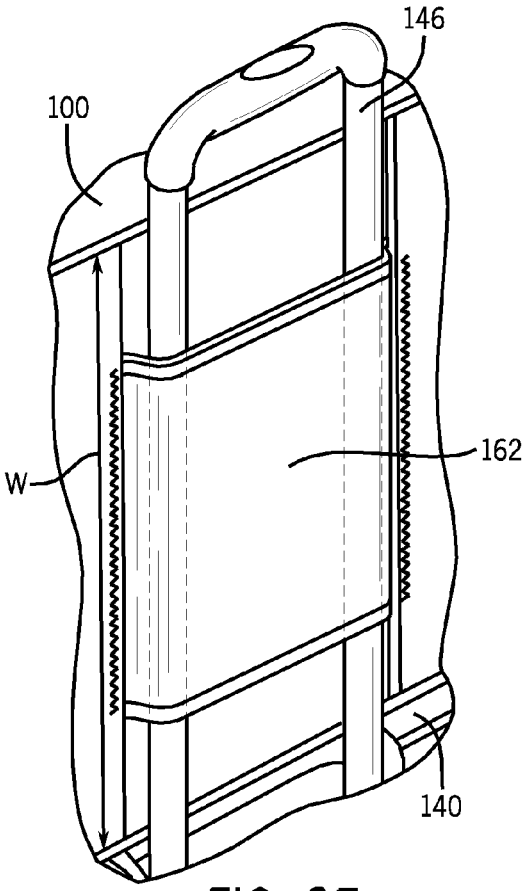
FIG. 3E is an enlarged detail view of an additional strap connecting a luggage article to a second luggage piece in accordance with some examples of the present disclosure.
Figure 3F:
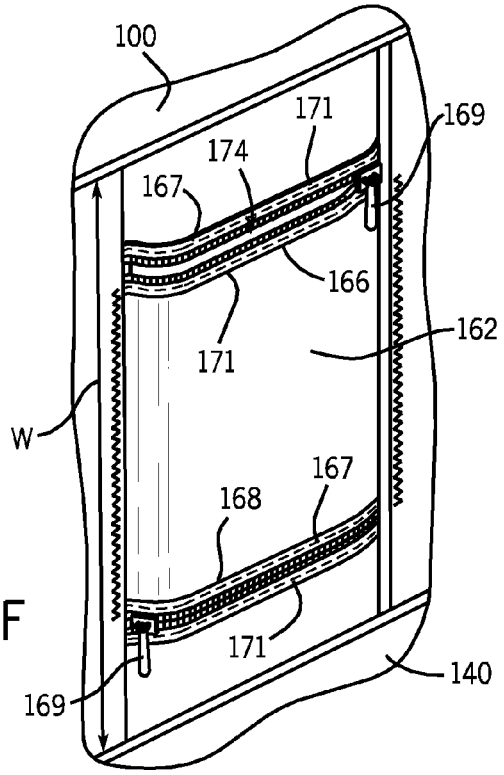
FIG. 3F is a fragmentary detail view of an additional strap connecting a luggage article to a second luggage piece in accordance with some examples of the present disclosure.

With reference to FIGS. 3A-3E, the first strap 162 may be constructed of substantially any type of material. For example, with reference to FIG. 3A, the first strap 162 may be constructed substantially of a fabric material. The fabric material may include ballistic nylon, canvas, leather, nylon, polyester, and/or PVC, among others, having a high durability and resistance to abrasions, tears, and/or scuffs. With reference to FIG. 3B, the first strap 162 may be constructed of a webbing material. The webbing material may include without limitation polypropylene, nylon, and/or polyester, among others. With reference to FIG. 3C, the first strap 162 may be constructed of a mesh material made from polypropylene, polyethylene, nylon, PVC, and/or PTFE, among others. With reference to FIG. 3D, the first strap 162 may include a connection mechanism 196 (e.g., a buckle) to connect portions of the first strap 162 together. For example, as shown in FIG. 3D, the first strap 162 may include a first portion 198 having a first connection member 200, and a second portion 210 having a second connection member 212. In such embodiments, the first strap 162 is defined by connecting the first and second connection members 200, 212 together. In each of the embodiments above, the first strap 162 may be a thin (see FIG. 3A) or a wide (see FIG. 3E) strap of resilient material designed for resilient deformation. As shown in the embodiment of FIG. 3E, the first strap 162 may extend across a substantial portion of the width W of the luggage article 100 (e.g., at least ¼ of the width W) to provide greater contact surfaces between the first strap 162 and the tow handle 146 of the second luggage piece 140. In some embodiments, the first strap 162, which may be considered a panel, may extend across the entire width W of the luggage article 100. The first strap 162 may be inextendable, or in some embodiments, the first strap 162 may be elastic, or partially elastic, and provide some degree of resilience.

As noted above, the first strap 162 may include a plurality of layers to provide a desired strength, rigidity, durability, look, and/or feel of the first strap 162. For example, as shown in FIG. 5, the first strap 162 may include first and second outer layers 214, 216, a reinforcing member 218 positioned between the first and second outer layers 214, 216, and at least one layer of padding 220 (e.g., foam) positioned between the reinforcing member 218 and at least one of the first and second outer layers 214, 216. As illustrated, the first and second outer layers 214, 216, the reinforcing member 218, and the layer(s) of padding 220 may be secured together along the first and second elongate edges 166, 168 of the first strap 162. As noted above, the trim piece 172 may be positioned adjacent the first and second elongate edges 166, 168 to, for example, conceal the edges 166, 168 from view. As seen in FIG. 4, the trim piece 172 may be a strip of material (e.g., neoprene or any other fabric material) having a C-shaped cross-section. A line of stitching 222 may connect the trim piece 172, the first and second outer layers 214, 216, the reinforcing member 218, and/or the layer(s) of padding 220 together along the first and second elongate edges 166, 168. The reinforcing member 218, which may be a plastic or metal insert and may be integrally formed in at least one of the first and second outer layers 214, 216, may be operable to increase the stiffness, strength, and/or rigidity of the first strap 162 as desired. In the embodiment of FIG. 4, the reinforcing member 218 is resilient to allow deformation of the first strap 162 without permanent deformation. In some embodiments, the reinforcing member 218 maintains the first strap 162 in close adjacent relationship with the major face 116, at least when the luggage article 100 is not mounted to the second luggage piece 140. In some embodiments, the reinforcing member 218 may position at least a portion of the first strap 162 away from the major face 116 to define the passage 174 through which the tow handle 146 of the second luggage piece 140 may extend.

With reference to FIG. 2, for instance, the luggage article 100 may include at least one carry handle. For example, as shown in FIG. 1, the luggage article 100 may include a fixed carry handle 224 attached to at least one of the minor faces 118 of the luggage article 100 (e.g., the left sidewall 112). In some embodiments, the luggage article 100 may include an extendable handle 226, which may be aligned along the outside of the base section 154 (e.g., along the rear wall 106) of the luggage article 100. The extendable handle 226 may be aligned along the base section 154 but positioned inside the luggage article 100 and extending through one of the minor faces 118 of the luggage article 100 (e.g., through the top end wall 108). Although described in association with the base section 154 and/or the minor faces 118, respectively, the extendable handle 226 and the fixed carry handle 224 may be associated with any face, wall, or side of the luggage article 100.

As noted above, the luggage article 100 may be formed from a variety of materials and means. For example, the luggage article 100 may be moldable hard side material, soft side material, or a combination of hard side material and soft side material. The soft side material may be nylon, canvas, polyester, leather, PVC, polypropylene, polyethylene, and/or PTFE, among others. The hard side material may be a thermoplastic material (self-reinforced or fiber reinforced), ABS, polycarbonate, polypropylene, polystyrene, PVC, polyamide, and/or PTFE, among others. The luggage article 100 may be formed or molded in any suitable manner, such as by plug molding, blow molding, injection molding, or the like. Additionally, the thickness of the luggage article 100 may be consistent, or may vary across the luggage article 100 depending on the desired rigidity, strength, and/or weight of the luggage article 100. For instance, the thickness may be greater near the wheel assemblies 160, the edges 120, 130, 132, 134, 136, and/or the split line 150.

Figure 3G:
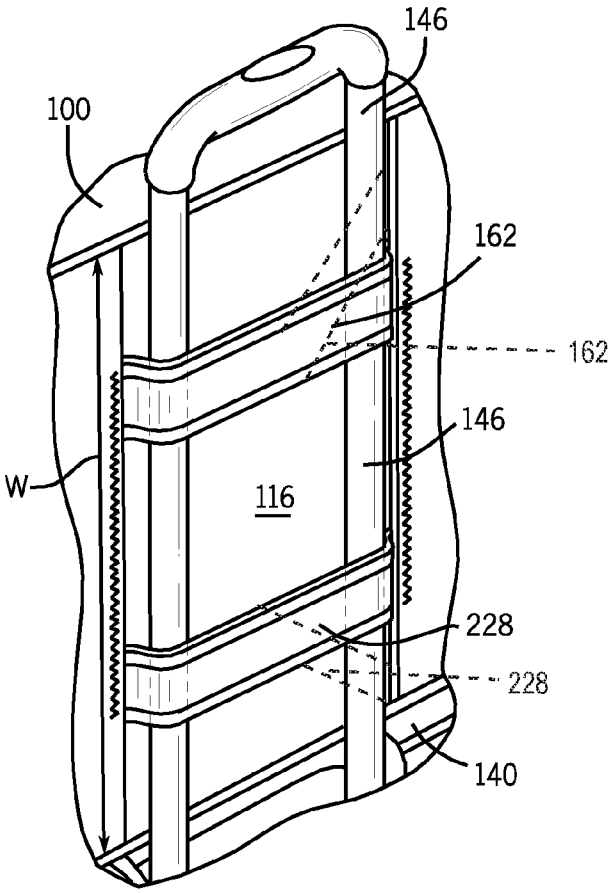
FIG. 3G is a fragmentary detail view of a multiple straps connecting a luggage article to a second luggage piece in accordance with some examples of the present disclosure.

Although shown and described as having a single strap, additionally or alternatively, the luggage article 100 may include a second strap 228, or any number of straps, defined on the major face 116 (see FIG. 3G). In such embodiments, the second strap 228 may be configured identical to the first strap 162. In such embodiments, the first and second straps 162, 228 may be spaced apart on the major face 116 and along the width W of the luggage article 100. For example, the first strap 162 may be positioned adjacent one of the rear left edge 134 and the rear right edge 136, and the second strap 228 may be positioned adjacent the other of the rear left edge 134 and the rear right edge 136. In such embodiments, the first and second straps 162, 228 may be positioned centrally between the opposing top and bottom end walls 108, 110 such that the distance between the bottom end wall 110 and the first and second straps 162, 228 is substantially equal to the distance between the top end wall 108 and the first and second straps 162, 228. In some embodiments, the first and second straps 162, 228 may be parallel to each other, although it is contemplated that the first and second straps 162, 228 may extend at an angle relative to each other. At least one of the first and second straps 162, 228 may extend parallel to one of the opposing sidewalls 112, 114 of the luggage article 100.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

The invention claimed is:

1. A stackable luggage article comprising:

a luggage case defined by opposing major faces, opposing top and bottom end walls, and opposing left and right sidewalls, the luggage case having a height extending a distance between the top and bottom end walls and a width extending a distance between the left and right sidewalls;

a plurality of wheel assemblies attached to the bottom end wall; and a first strap affixed to a major face, wherein:

the first strap extends vertically along at least a portion of the distance between the opposing top and bottom end walls to mount the luggage article substantially orthogonal to a second luggage piece; and at least a portion of the first strap is spaced away from the major face.

2. The luggage article of claim 1, wherein the first strap includes a reinforcing member.

3. The luggage article of claim 1, further comprising a second strap affixed to the major face, the first and second straps being spaced apart.

4. The luggage article of claim 3, wherein the first strap extends parallel to one of the opposing sidewalls of the luggage article.

5. The luggage article of claim 1, wherein a tow handle of the second luggage piece is receivable through the first strap of the luggage article to mount the luggage article to the second luggage piece.

6. The luggage article of claim 5, wherein one of the opposing sidewalls of the luggage article abuts a top wall of the second luggage piece.

7. The luggage article of claim 5, wherein a portion of the tow handle is perpendicular to the length of the first strap when the luggage article is mounted to the second luggage piece.

8. The luggage article of claim 5, wherein the first strap includes:

first and second elongate edges; and opposing ends, wherein:

the opposing ends are affixed to the major face; and the first and second elongate edges are openable to permit the tow handle to be received through the first strap.

9. The luggage article of claim 8, wherein at least one of the first and second elongate edges are closeable by a zipper to form a pocket defined at least partially by the major face and the first strap.

10. The luggage article of claim 8, wherein:

the major face is defined by a plurality of panels, the intersections between the plurality of panels defining edges; and the opposing ends of the first strap are attached to two edges.

11. The luggage article of claim 1, wherein the luggage article includes four spinning-type wheel assemblies.

12. The luggage article of claim 1, wherein the first strap extends across the entire width of the luggage article.

13. A luggage assembly comprising:

a first luggage article having:

opposing major faces;

opposing minor faces extending between the opposing major faces;

a plurality of wheels attached to one of the opposing minor faces; and a strap affixed to one of the opposing major faces, the strap extending between at least a portion of the minor faces and upwardly from adjacent the minor face with a plurality of wheels to adjacent the other of the opposing minor faces; and a second luggage article having a tow handle, wherein:

the tow handle of the second luggage article is received through the strap of the first luggage article such that the first luggage article is mounted substantially orthogonal to the second luggage article.

14. The luggage assembly of claim 13, wherein the first luggage article is stacked vertically above the second luggage article.

15. The luggage assembly of claim 13, wherein a height of the first luggage article is defined between the minor faces and substantially corresponds to or is less than a width of the second luggage article, the width defined between opposing sidewalls of the second luggage article.

16. The luggage assembly of claim 13, wherein the first luggage article further comprises opposing sidewalls and a width of the first luggage article is defined between the opposing sidewalls and substantially corresponds to or is less than an extension height of the tow handle of the second luggage article.

17. The luggage assembly of claim 13, wherein the strap extends at an angle more or less than orthogonal to a width of the first luggage article.

18. The luggage assembly of claim 13, wherein the strap allows the first luggage article to lay flat on top of the second luggage article.

19. A method of mounting a first luggage article to a second luggage article, the method comprising:

affixing a first strap to a major face of the first luggage article such that the first strap extends substantially orthogonal to a width of the first luggage article, the width defined by a distance between opposing sidewalls, at least a portion of the first strap operable to define an opening between the first strap and the major face; and passing a tow handle of the second luggage article through the opening defined between the first strap and the major face.

20. The method of claim 19, further comprising resting an opposing sidewall of the first luggage article against a top wall of the second luggage article.

* * * * *